US006698354B2

(12) United States Patent
Juffinger et al.

(10) Patent No.: US 6,698,354 B2
(45) Date of Patent: Mar. 2, 2004

(54) METHOD AND DEVICE FOR PRODUCING A PRINTING BLOCK

(75) Inventors: Josef Juffinger, Thiersee (AT); Karl Thaler, Kramsach (AT)

(73) Assignee: Schablonentechnik Kufstein Aktiengesellschaft, Kufstein (AT)

( * ) Notice: Subject to any disclaimer, the term of this patent is extended or adjusted under 35 U.S.C. 154(b) by 49 days.

(21) Appl. No.: 10/154,827

(22) Filed: May 28, 2002

(65) Prior Publication Data

US 2002/0189471 A1 Dec. 19, 2002

(30) Foreign Application Priority Data

May 25, 2001 (EP) ..... 01112706

(51) Int. Cl.[7] ..... B41C 1/05

(52) U.S. Cl. ..... 101/401.1; 101/395; 219/121.76; 347/239; 347/255

(58) Field of Search ..... 101/150, 170, 101/395, 401.1; 219/121.61, 121.68, 121.76, 121.82; 430/306; 347/237, 239, 247, 255, 262

(56) References Cited

U.S. PATENT DOCUMENTS 2,854,336 A * 9/1958 Gutknecht ..... 430/323
4,046,071 A * 9/1977 Mizuno et al. ..... 101/395
4,115,119 A * 9/1978 Okai et al. ..... 430/306
4,213,819 A * 7/1980 Werthmann ..... 216/54
4,600,667 A * 7/1986 Uchida ..... 430/22
4,610,950 A * 9/1986 Milliken ..... 430/306
5,427,026 A 6/1995 Kuwahara ..... 101/401.1
6,150,629 A * 11/2000 Sievers ..... 219/121.62
2001/0052924 A1 * 12/2001 Steinke et al. ..... 347/225
2002/0148818 A1 * 10/2002 Satou et al. ..... 219/121.73
2003/0006221 A1 * 1/2003 Hong et al. ..... 219/121.72
2003/0047545 A1 * 3/2003 McKee et al. ..... 219/121.71

FOREIGN PATENT DOCUMENTS

JP 2001-71451 * 3/2001
WO 97/19783 6/1997

* cited by examiner

*Primary Examiner*—Stephen R. Funk
(74) *Attorney, Agent, or Firm*—Birch, Stewart, Kolasch & Birch, LLP

(57) ABSTRACT

To produce a printing block, a relief is introduced into a surface of a printing block blank. To form the relief, material of the printing block blank is removed along tracks. The material is removed by radiation to form recesses, between which plateaus will be formed. The surface of the printing block blank located between the recesses is also removed by radiation in order to obtain lower-lying plateaus.

36 Claims, 7 Drawing Sheets

METHOD AND DEVICE FOR PRODUCING A PRINTING BLOCK

BACKGROUND OF THE INVENTION

1. Field of the Invention

The invention relates to a method and a device for the production of a printing block. The printing block may, for example, be a flexible or inflexible printing block, which can act as a relief printing or gravure printing block.

2. Description of the Relevant Art

To produce the flexographic printing block with the aid of a conventional $CO_2$ laser it is already generally well known for material to be burned out directly from a printing plate, which may be a polymer plate for instance, in order in this manner to produce a relief in the printing plate. In this process, the $CO_2$ laser is permanently power-modulated to obtain recesses bounding the relief in the surface of the printing plate.

SUMMARY OF THE INVENTION

Furthermore, for the production of a flexographic printing block PCT/EP96/05277 already discloses the use of two laser beam sources in order with the first laser beam source to obtain fine structures in a desired profile, while by means of the second laser beam source lower-level regions in the profile are produced.

The state of the art further includes methods for placing small raster dots in a relief at a lower level. This is done in that focused beams staggered close beside one another strike corresponding regions and remove the material in conformity with the focused course of the beams. This then gives rise to a sort of cone whose conical apex is located at a greater or lesser depth in the relief. If in subsequent printing an add-on is arranged under the printing block, that is to say a kind of underlay, then due to this underlay the tip of the cone is lifted back again into the region of the print area. However, printing material adheres quite poorly to this cone tip so that a less than sharp printed image results. Cone tips representing raster dots of this kind are provided by way of example in the vicinity of full print areas so that in subsequent printing the full print areas may be given more prominence. In subsequent printing the said underlay comes to lie beneath a full print area so that during printing a high contact pressure is obtained. Where the depth of the raster dots surrounding the full print area not reduced in advance the latter would press too heavily against the subsequent print area and buckle which would likewise adversely affect the printed image.

It is an object of the invention to specify a method for the production of a printing block, in particular a flexographic printing block, with which fine relief structures to be given prominence in subsequent printing may be produced in such a way that they result in a flawless printed image. Moreover, a corresponding device for producing such printing blocks is to be provided.

In a method according to the invention for producing a printing block, in particular a flexographic printing block, a relief is introduced into the surface of a blank of the printing block in that material of the printing block blank is removed in regions along tracks by radiation in order by this means to form recesses between which plateaus come to lie. Now, according to the invention the surface of the printing block blank located between the recesses is also removed by radiation in such a way that as a result lower-lying plateaus are obtained.

Thus, contrary to the most recently described state of the art fine raster dots later to be given prominence in the relief are not produced in that due to conical and closely adjacent beams more or less low-lying cone tips are blocked in the relief, but rather in that initial plateaus between the respective recesses located initially in the surface of the printing block blank are lowered in depth more or less uniformly in order to obtain lower-lying plateaus whose plateau surface comes to lie as before more or less parallel to the surface of the printing block blank. If, during subsequent printing, these plateaus are lifted, that is to say lifted into the print area, then sufficient printing material remains adhering to them to yield a sharp printed image. This procedure is used when, for example, a relatively large full print area is surrounded by a fine raster so that the full print area is given more prominence.

According to a refinement of the invention, in order to set the depth of the lower-lying plateaus the surface of the printing block blank located between the recesses can be removed by radiation whose intensity or power can be correspondingly adjusted. Thus, if the plateaus lying between the recesses are to be burned away to a greater depth the intensity or power of the beam must be increased and vice versa.

According to another refinement of the invention, in order to set the depth of the lower-lying plateaus the surface of the printing block blank lying between the recesses can also be removed by repeated irradiation. Thus, this multiple irradiation of the printing block blank in the region of the plateaus to produce the lower-lying plateaus ensues with a time delay or successively so that a lower-lying plateau is obtained as it were by repeated scooping out.

Since the lower-lying plateaus of the relief structure are carved out by repeated exposure to radiation or burning off the power of the beam can be relatively low which has the consequence that even very fast modulators, precisely whose beam power when used has to be limited in order to save the modulators from destruction, acousto-optical modulators for instance, can be used for switching the beam power on and off. Due to repeated and hence relatively gentle erosion of the plateau it is also achieved that after each removal operation the printing block material cools again before removal of material starts afresh which has the result that the printing block material in the region of the plateau does not heat up so much and hence the relief can be built up in decidedly exact manner or true to shape. Between the individual burn-off operations the material stripped off can also be taken away, eg sucked off, which allows more precise working in the next removal operation and results in structures of better quality.

In doing so the irradiation of the plateaus can ensue along a particular track using one and the same beam which is guided repeatedly along a track. However, it is also possible for irradiation along a track to be done using a plurality of beams which are conveyed one after the other along the same track. For this purpose it is possible in principle for a plurality of stations to be arranged beside one another in a direction running transverse to the longitudinal direction of the track when a corresponding relative shift between track and beams ensues. However, a plurality of beams located alongside one another in a direction running in the longitudinal direction of the track may also be used.

According to a refinement of the invention the depth of the lower-lying plateaus may be set differently as a function of their position in the relief. Thus, by way of example the depth of the lower-lying plateaus may increase in the direction towards a full print area located in the surface of the printing block blank in order to ensure that during subsequent printing the lower-lying plateaus in the vicinity of the full print area are lifted just into the print area when an add-on or underlay is located under the full print area.

It should be pointed out that the recesses in the surface of the printing block blank present between the plateaus may also be constructed by multiple irradiation of the surface of the printing block blank. This multiple irradiation of the printing block blank to produce the lower-lying recesses then occurs with a delay or successively so that a lower-lying recess is obtained as it were by repeated scooping out. However, the recesses could also be obtained by appropriate control of the power of the beam over the region of a recess.

In a further development of the invention the exposure of the printing block blank to radiation is done using laser radiation since in this manner the requisite radiation energy can be readily made available. In this respect focused laser radiation may be used.

In order to machine the printing block blank along the tracks the beams or laser beams may be moved relative to the printing block blank or this is done in such a way that the printing block blank is moved relative to the fixed beams. Alternatively, the beams and the printing block blank can both be moved relative to one another.

In doing so a printing block blank is used, for example, which has an elastic material forming a printing surface, polymer material, silicone or rubber for instance.

Thus, for example a plate-like printing block blank composed of polymer material or other suitable elastic material can be laid onto the surface of a rotatably mounted cylinder and there be fitted firmly in place, for instance by clipping on, by suction by means of vacuum, by magnets, etc. However, to form a printing block blank elastic or polymeric material may also be drawn onto or applied to a rotatably mounted cylinder. For example, these can be flexible tubes which are drawn onto the cylinder or liquid material or polymer material can be applied by knife coating, spraying and immersion, etc.

According to a very advantageous refinement of the invention the exposure of the printing block blank to radiation along the track in question takes place as a function of a data file which each is assigned to the plateaus lying between the recesses. Thus, the removal of the layers of material on the printing block blank in the region of the plateaus occurs under purely digital control so that changes in the radiation power or switch-on/switch-off operations may be carried out very rapidly. At the same time data files can likewise be used to form the recesses lying between plateaus which can also be combined with the data file first mentioned to form an overall file in such a way that the data files form, as it were, links in a chain which are successively worked through.

In doing so the respective files are used for modulating the beams or switching them on and off. These data files could be used for example to control acousto-optical modulators with the aid of which the beams or laser beams are switched on and off and whose mode of operation is known.

In order to allow beams of differing intensity to pass through the acousto-optical modulators can be actuated by different control voltages. In that respect different control voltages may be assigned to the respective data files for modulating the beams in order when using one of the data files in question to use one of the control voltages in question to actuate a modulator. The control voltage in question is then switched on in conformity with the data file. This switched control voltage is then applied to the modulator.

To generate the control voltage passed to the modulator a fast digital-analogue converter, for example, may be used which can, for example, be an 8-bit converter. A digital value of zero would yield the control voltage 0, while a digital value between 1 and 255 would deliver a control voltage of correspondingly set level to the modulator. However, it is also possible to switch a preset control voltage by means of an analogue switch, wherein a data file having only the values 0 and 1 is applied to the control or switching input port of the analogue switch.

A device according to the invention for producing a printing block, in particular for producing a flexographic printing form, contains a mounting for holding a printing block blank, an optical device for irradiating a surface of the printing block blank along a track by means of at least one beam in order by this means to remove material from regions of the printing block blank to form recesses, and a control device which making use of a data file containing beam-on and beam-off switching commands controls changes in the intensity of the at least single beam on its way along the track. This device distinguishes itself in that the control device is constructed in such a way that it makes available at least one data file each containing beam-on and beam-off switching commands in order also to remove by radiation the surface of the printing block blank lying between the recesses so that by this means lower-lying plateaus are obtained.

Thus, with the aid of the device it is possible to obtain relatively small plateaus at a lower level with respect to the original surface of the printing block blank whose plateau surface is as before practically parallel to the original surface of the printing block or concentric with the latter if this should be arched. Thus, the lower-lying plateaus are no longer restricted to regions in the shape of a cone tip but rather extend over an area so that printing material (ink, paste and the like) adheres better thereto giving rise to a high-grade printed result.

In doing so, according to a refinement of the invention the optical device is constructed in such a way that it emits at least one beam, the control device being constructed in such a way that one beam in each case passes through one and the same track several times and on each passage of the track data file or a new data file can be read out. If, for example, only one beam is present and if the original plateaus are to be peeled off or burned off in a plurality of successive stages the beam would have to pass through any track in question a corresponding number of times.

It is also possible, however, that the optical device emits a plurality of beams which are each controllable by a separate data file. In this case all beams would have to traverse one and the same track one after the other.

For this purpose the beams may be arranged alongside one another in a direction running transverse to the longitudinal direction of the track so that as a result of appropriate displacement in the transverse direction the beams can be brought into alignment with the track one after the other. Alternatively, however, the beams may be arranged beside one another in a direction running in the longitudinal direction of the track. In this case the beams are actuated by the data files with a time delay which corresponds to the spacing of the beams in the longitudinal direction of the track.

The beams used may be focused beams, focused laser beams for instance.

In principle the printing block blank can be a plate-shaped blank or a cylindrical printing block blank. It is of elastic construction at least on its surface and is preferably composed of polymeric material or contains at least one such. However, it may also be composed of silicone, rubber or another material, metal for instance.

For machining the printing block blank when constructed in the form of a plate the latter can be machined, for example, in the flat state when beams are guided along tracks and kept at a distance parallel to it. The beam sources and printing block blank could then be displaced relative to one another in parallel planes.

According to an advantageous refinement of the invention the printing block blank is constructed as a cylinder mounted to rotate about its longitudinal axis which carries on its surface an elastic material, for example polymeric material. This can be of plate-like construction and be laid around its surface. If it is fastened in the form of a plate on the cylinder surface the plate can also be removed from the latter again after machining in order to be used as a flat printing plate. However, the elastic or polymeric material may also remain fixed on the surface of the cylindrical support after it has been drawn onto the latter or applied in a different form, for instance by an immersion, knife-coating or spraying process and the like. In this case the entire cylinder is later used as a printing cylinder.

When machining or irradiating the printing cylinder to produce the surface relief the latter can be turned while at the same time a carriage carrying at least parts of the optical device and arranged displaceably in the direction of the longitudinal axis of the cylinder is moved. Items present on this carriage may be, for instance, tilted mirrors for diverting laser beams or laser beam sources may be mounted directly on it. It is also possible when turning the cylinder about its longitudinal axis to displace the latter simultaneously also in the direction of its longitudinal axis so that the surface of the printing block blank can be machined by an optical device in a fixed position. This variant would be advantageous if the optical device itself is composed of a large number of beam sources for producing a large number of beams and hence maladjustment due to vibrations is relatively great.

It has already been mentioned that for control of intensity or control of power, that is for switching the beams on and off, modulators are provided which are actuable via the data files. In doing so these can preferably be acousto-optical modulators which are actuable at high speed.

At the same time a particular one of the modulators is connected to at least one analogue switch through which a control voltage corresponding to the pattern information can be fed to the modulator, wherein the analogue switch can be switched by the data file. By this means very precise digital control of the machining beam or laser beam is possible.

Thus, for example, according to a refinement of the invention a modulator can be connected to the outputs of a plurality of analogue switches which are each switchable by one of the plurality of data files (pattern information) needed for engraving along a track, wherein the analogue switches each switch different control voltages. Depending on the data file and hence the selected analogue switch, a different control voltage corresponding to the pattern information arrives in this way at the modulator so that depending on the selected control voltage the latter emits a beam having greater or lesser intensity or power.

According to another refinement of the invention, however, a plurality of modulators may also be present to each of which an analogue switch is assigned which are each switchable by one of the plurality of data files needed for engraving along a track, wherein the analogue switches each switch different control voltages.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and of the scope of the invention will become apparent to those skilled in the art form this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
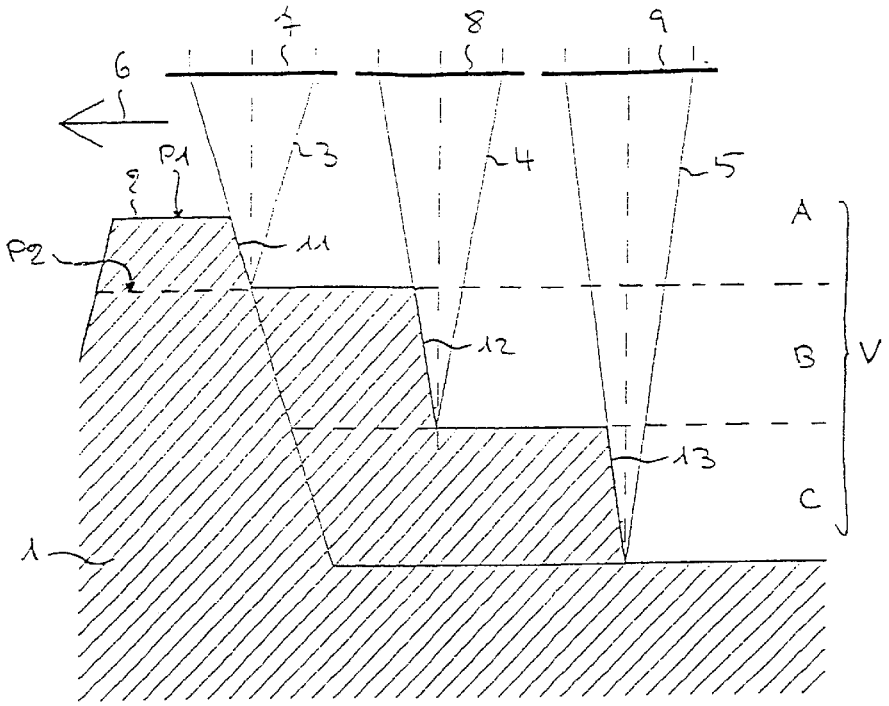
FIG. 1 is a cross sectional view illustrating the machining of a printing block blank, producing a relief in its surface.

The principle of operation underlying the invention is described in more detail below with reference to FIG. 1. In FIG. 1, the reference number 1 identifies a printing block blank produced from polymer material. To produce a flexographic printing block, for example, a relief is engraved in a surface 2 of the printing block blank 1 with the aid of e.g. three focused laser beams 3, 4 and 5 by burning away regions of polymer material on the printing block blank 1. More or fewer than three laser beams could be used.

To burn away the regions, the laser beams 3, 4 and 5 are moved in succession along a track running on the surface 2 in the direction of the arrow 6. The laser beam 3 is the leading laser beam and acts on the surface 2 of the printing block blank 1 first. It is followed along the same track with a time delay by the laser beam 4 which itself is followed along the same track again with a time delay by laser beam 5.

Depending on the depth of a recess to be incised into the surface 2 of the printing block blank 1 for the purpose of forming the relief, either only laser beam 3, laser beams 3 and 4 or all the laser beams 3, 4 and 5 are used. Should the recess be relatively flat, only laser beam 3 is switched on which burns away only a section A below the surface 2 of the printing block blank 1. Laser beams 4 and 5 are then not switched on.

If on the contrary, deeper recesses are desired the laser beams 4 and 5 are also used. In this case, the upper section A of the printing block blank 1 is again burned away, first of all with the aid of the laser beam 3, while a short time later the section B located under the base of section A is burned away with the aid of the laser beam 4. For a still deeper recess, after use of laser beam 4, the section C located under the base of section B is burned away with the aid of the laser beam 5, etc. Thus, by means of the laser beams 3, 4 and 5, relief regions in which relatively deep recesses are to be produced are irradiated several times one after the other in order, in successive steps, to burn away or to excavate further the base of the previously obtained recess.

Using the principle described above surface regions of the printing block blank 1 likewise lying according to the invention between the respective recesses V are removed. If the region of the surface 2 located in the longitudinal direction of the track 6 between successive recesses V is designated as a plateau P1, then in this region a lower-lying plateau P2 may be produced in that the laser beam 3 remains switched on in the region of the plateau P2 or a further laser beam not illustrated is switched on and remains so up to the start of the next recess V. This other laser beam could also be one having relatively low intensity or power by means of which the plateau P2 is not laid as deeply as in FIG. 1. The key factor for the construction of the plateau P2 is that the plateau P1 initially lying in the surface 2 is uniformly removed or peeled off or burned off between successive recesses V by means of a beam moved in the longitudinal direction of the track 6 so that the plateau P2 lies as before with its surface parallel to the actual surface 2 of the printing block blank 1. If for a subsequent printing operation the plateau P2 is lifted into the print area by an underlay to be fitted below the printing block printing material (paste, ink and the like) can deposit well on the plateau P2 so that flawless printing is ensured. It is obvious that the surface 2 of the printing block blank 1 need not be removed to the plateau 2 between all successive recesses V, but rather only in the event that this desired or is necessary for technical printing reasons. This is the case, for example, when relatively large full print areas are to be surrounded by a raster to give them great prominence and the raster peaks must be lowered, this being all the further the closer they are to the full print area. The lowering of these raster peaks can then be done by repeated exposure to radiation in line with the principle shown in FIG. 1 or by single exposure to radiation in each case using a beam having the power to allow removal of material to the desired depth.

A further advantage of the above principle is that in forming a recess V, due to the repeated removal of the base of one and the same region using only one or a plurality of laser beams the beam power can be kept relatively small which has the consequence that optical switching elements may be used for switching the laser beams on and off which have relatively fast switching characteristics but must not be loaded with excessively high power. In this way fine and very deep structures can be produced at the same time which results in a considerable improvement in quality in the production of printing blocks (printing plates, printing rollers, etc). Examples of switching elements of the said type which could be used are acousto-optical modulators, deflectors or beam deflectors such as mirrors, etc.

The printing block blank in FIG. 1 may be, for example, a plate-shaped blank which is machined in the flat state or a cylindrical printing block blank which is located by way of example on the surface of a rotatably mounted cylinder and can be removed again from the latter. However, the cylinder itself could also be referred to as a printing block blank if it were coated on its surface with polymer material for example.

According to a refinement of the invention the laser beams 3, 4 and 5 could have different power levels. The leading laser beam 3, for example, could have a lower power than the two following laser beams 4 and 5 so that with laser beam 3 first of all the edges of the relief can be better defined at relatively low power. Lower-lying regions of recesses can then be burned away using the more powerful laser beams 4 and 5. Thus, for example, for laser beam 3 a 100 watt $CO_2$ laser beam could be used while laser beams 4 and 5 are 200 watt $CO_2$ laser beams.

The laser beams themselves are focused with the aid of lenses 7, 8 and 9, for which purpose these lenses may be located in the same plane for example but have different focal lengths depending on the depth of the region to be burned away by the laser beams. In FIG. 1 the lens 7 has the shortest focal length and lens 9 the longest focal length. Of course lenses of the same focal length in different planes could also be used if desired. In less precise reliefs lenses having approximately the same focal length could also lie at the same distance from the printing block blank 1. It would also be possible to use different beam diameters for the individual laser beams 3, 4 and 5 if desired.

Figure 2:
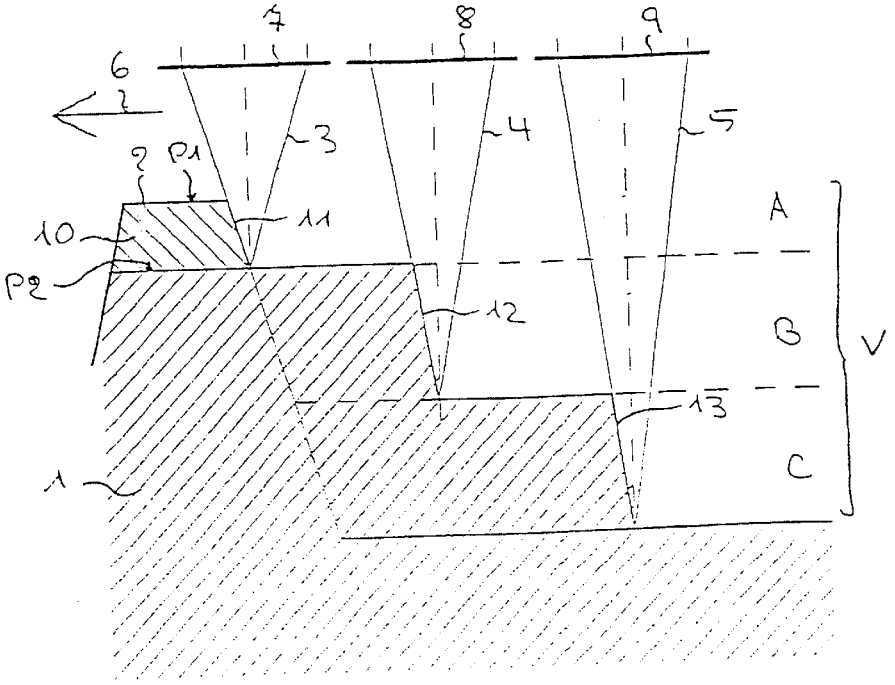
FIG. 2 is a cross sectional view illustrating the machining of a printing block having a spectrally adapted surface.

FIG. 2 shows a variant of the principle shown in FIG. 1. Here an upper region 10 of the printing block blank 1 and the laser beam 3 for working on this upper region 10 are spectrally matched to one another. For this purpose the surface of the printing block blank 1 is coated in the upper region 10 with corresponding material which is particularly sensitive to the wavelength of the laser beam 3. In this case the laser beam 3 can be produced eg by a YAG laser whose wavelength is 1,060 $\mu$m. The beam itself can have a power ranging from 50 to 100 watts. By means of such a laser a beam width at the focus of approximately 10 $\mu$m is obtained so that distinctly fine structures can be produced in the surface region of the printing block blank 1. For this purpose, however, the material in the region 10 must be selected so that it can be readily burned away by the laser beam 3. The remaining laser beams 4 and 5 may again be generated by $CO_2$ lasers of 200 watts each so that lower level regions at a distance from the edges of the relief can be burned away. Here such high precision is not required so that beam widths in the focal region of 30 to 35 $\mu$m are acceptable.

In FIGS. 1 and 2 it may be seen how the relief structures are shaped like a pedestal. For this purpose the laser beams 3, 4 and 5 in the direction of the track 6 are switched off at different points in the direction of the track 6. This then yields a stepped pedestal shape, wherein the inclination of the sides corresponds approximately to the course of the focused laser radiation. The flanks of the pedestal are identified in FIGS. 1 and 2 by 11, 12 and 13.

Figure 3:
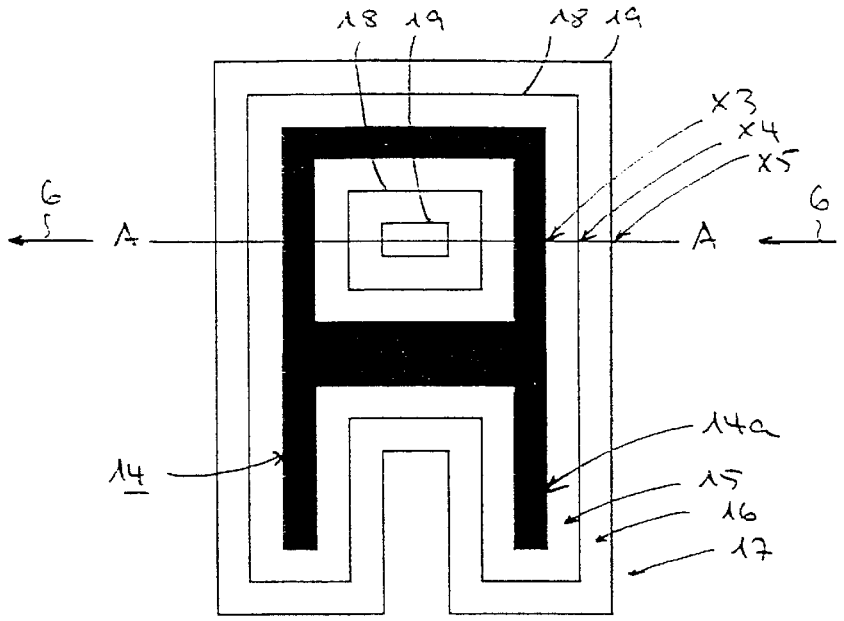
FIG. 3 is a plan view of a basic relief pattern with borders to identify relief regions, wherein parts of the basic relief pattern and the relief regions are at different depths by comparison with the basic pattern.

FIG. 3 shows a basic relief pattern in the form of a uniformly blackened region. This basic relief pattern 14 is the area to be printed and must be surrounded at its perimeter by lower-lying regions 15, 16 and 17. The material of the printing block blank 1 must, therefore, be burned away in the regions 15, 16 and 17. The resultant structure may be seen in FIG. 4. In this case it is a cross-section along the line A—A in FIG. 3.

The basic relief pattern 14 shown in FIG. 3 is used for switching the laser beams on and off. The basic relief pattern can be represented first of all on the screen of a computer and be temporarily stored in an electronic memory. Tracks are then laid down on which the laser beams are guided when the relief is engraved. It may be assumed that the line A—A in FIG. 3 is such a track. The basic relief pattern 14 can be provided in front or in the rear with borders 18, 19, that is to say on the inside and on the outside in order to define the regions 15, 16, 17 in which the material of the printing block blank 1 is to be burned away. At the points of intersection of the track A—A in FIG. 3 with the basic relief pattern or the borders 18, 19 there are then turn-on and turn-off points for the laser beams which sorted according to the regions are combined to form data files.

Figure 5:
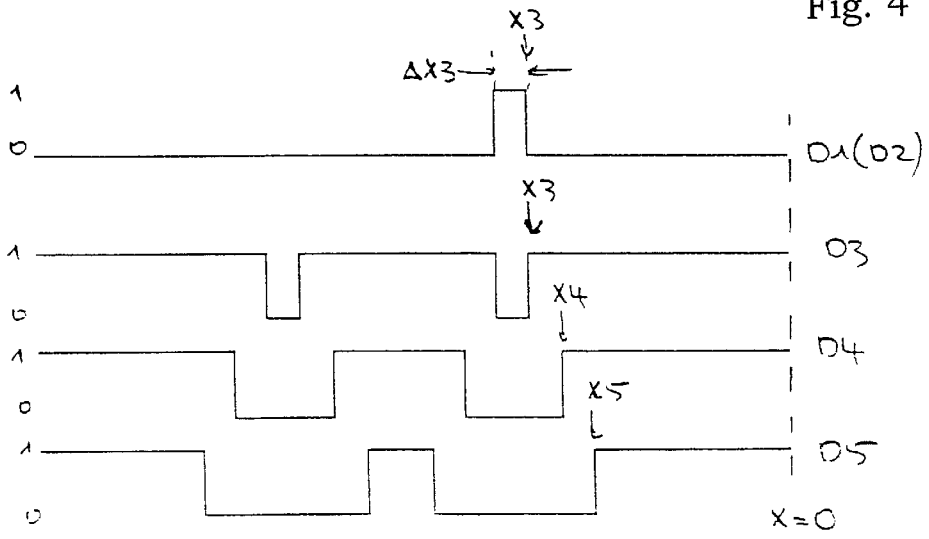
FIG. 5 illustrates four data files used to generate the basic relief pattern shown in FIG. 4.

If, for example, one moves along the line A—A in FIG. 3 in the direction of the arrow 6, to be more precise with the laser beams 3, 4 and 5 in FIG. 1, the first point of intersection of the track A—A with the basic relief pattern 14 gives rise to a turn-off point X3 for the laser beam 3 which is shown in FIG. 5. The point of intersection of the border 18 with the track A—A then yields a turn-off point X4 for laser beam 4 while the point of intersection of the border 19 with the track A—A produces a turn-off point X5 for laser beam 5. The points X4 and X5 are also sketched in in FIG. 5. On moving further along the track A—A in FIG. 3 in the direction of the arrow 6 turn-on points again arise for the laser beams 3, 4 and 5, and again turn-off points, etc so that finally the three data files D3, D4 and D5 shown in FIG. 5 for switching the laser beams 3, 4 and 5 off and on are obtained. To lower the region 14*a* one could switch the laser beam 3 on again (or have it switched on) or switch on another laser beam which is not shown. This could be done under control of the data file D1. If there is another laser beam this could also be controlled by a data file D2 which via an analogue switch controls a lower or higher voltage and ensures that the other laser beam is switched with lesser or greater intensity or power.

Figure 4:
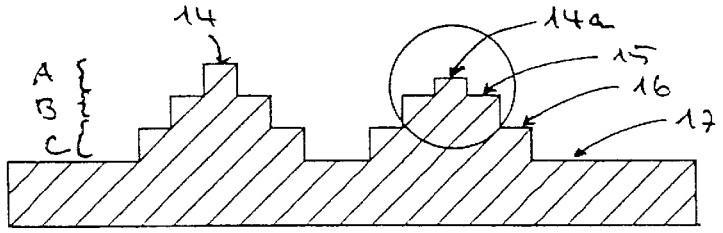
FIG. 4 is a cross sectional view along the line A—A of FIG. 3 illustrating a finished relief in the surface of the printing block blank.

The data files D1, D2, D3, D4 and D5 each possess values of "1" and "0" and serve to actuate acousto-optical modulators which for their part are used for switching the laser beams 3, 4 and 5. The start of a track in FIG. 5 is say at X=0 so that in the first pass of the track using laser beam 3 the regions 17, 16 and 15 over section A are burned away until laser beam 3 is switched off at X3. In the second pass of the track laser beam 4 is switched on at X=0 and switched off at X4 so that by means of the second laser beam 4 section B is burned over the regions 17 and 16. In the third pass of the track laser beam 5 is switched on at X=0 and switched off at X5 so that now over section C only region 17 is burned off. Thus, viewed from the location X=0 laser beam 3 is switched off latest and laser beam 5 earliest. After passing through the right-hand branch of the basic relief pattern in FIG. 3 laser beams 3, 4 and 5 are then switched on again in that sequence, etc. Instead of having laser beam 3 switched on at X3 via ΔX3 another beam could also be switched on for a fourth pass of the track at time X3 via ΔX3 in order to cut the relief in region 14*a* as shown in FIGS. 4 and 5.

The turn-on and turn-off points or data files may be generated automatically after producing the borders 18 and 19 and determining the track A—A and the track direction with the aid of suitable computer programs.

Figure 6:
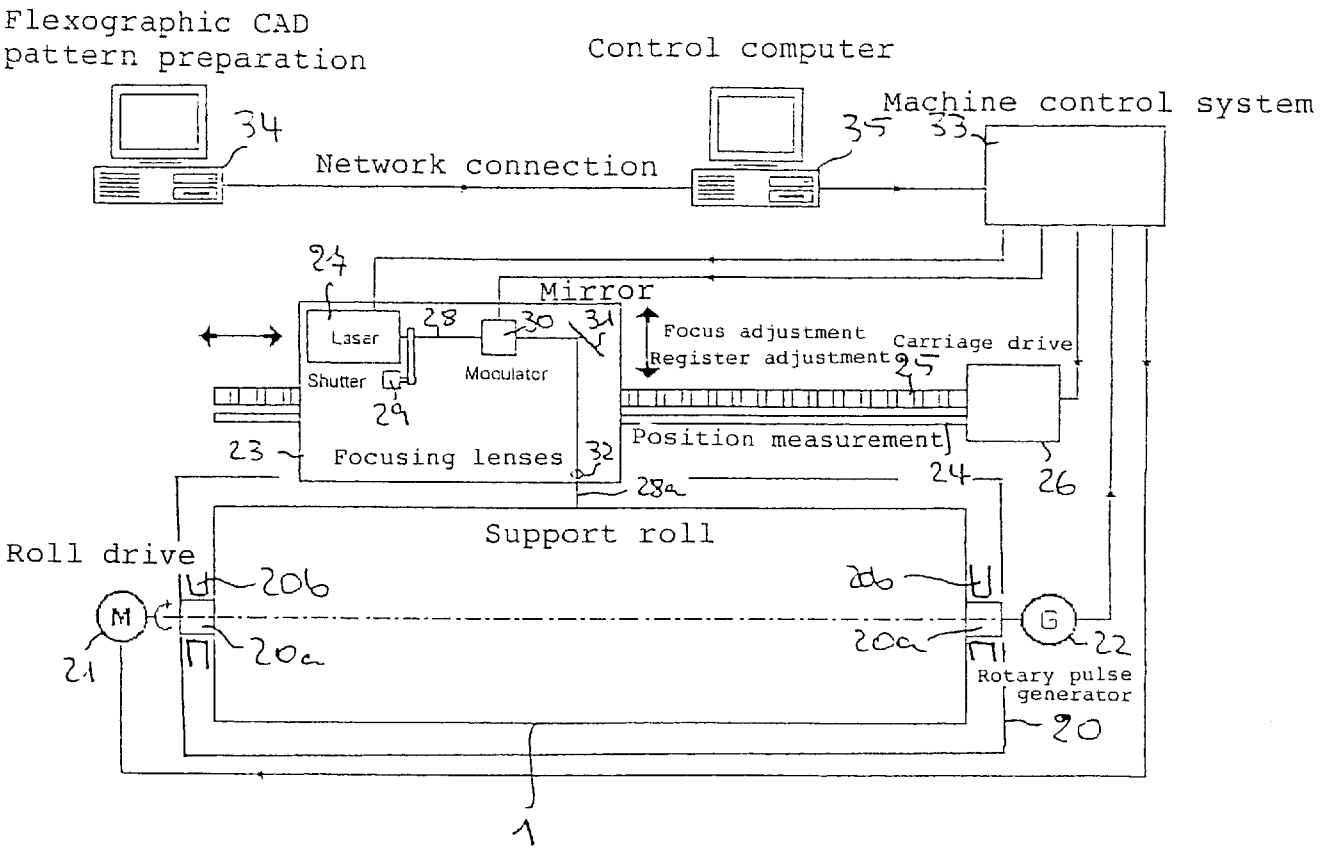
FIG. 6 illustrates a device according to a first embodiment of the invention for producing a printing block.

FIG. 6 shows the structure of a device according to the invention for producing a printing block, a flexographic printing block for instance.

The device includes a laser engraver with a machine bed 20. Mounted rotatably on the machine bed 20 is the printing block blank 1 to be engraved constructed in this case in the form of a hollow cylinder. For this purpose the printing block blank 1 possesses a central shaft 20*a* which is accommodated by bearings 20*b* provided on the machine bed 20. The printing block blank 1 can be turned about its central axis by a motor 21. An encoder 22 or rotary pulse generator serves to produce pulses which correspond to the rotary position at the time of the printing block blank 1. A carriage 23 is moved on guides 24 parallel to the axis of the printing block blank 1. A screw spindle 25 serves to drive this carriage 23 along the guides 24, wherein the screw spindle 25 is turned by a drive 26 in one or other direction in order to carry the carriage 23 along accordingly.

Mounted on the carriage 23 is a laser 27 which emits a laser beam 28. The laser beam 28 is blocked off by means of a shutter 29 when it is not needed. The laser beam 28 passes through a modulator 30 for switching it on and off and is deflected, by eg 90°, by a deflector mirror 31 and focused by a lens system 32 onto the surface of the cylindrical printing block blank 1. With the aid of the focused laser beam 28 the upper regions of the printing block blank 1 are burned off in part in order to engrave a relief into the surface of the printing block blank 1. For this purpose the cylindrical printing block blank carries on its surface a polymer coating so that after introducing a relief a flexographic printing block is obtained.

For operational control of the unit there is a machine control system 33 which is connected via control leads to the laser 27, the modulator 30, the rotary drive 26, the motor 21 and the rotary pulse generator 22.

The device in FIG. 6 further includes a CAD system 34 which is connected to a control computer 35 which serves in turn to actuate the machine control system 33.

With the aid of the CAD system 34, a designer can draft a pattern on the associated monitor screen, for instance the basic relief pattern 14 shown in FIG. 3. Using appropriate commands the designer can then define on the CAD system borders 18 and 19 relative to the basic relief pattern 14, which determine regions in which the surface of the printing block blank 1 is to be removed outside the basic relief pattern.

The designer can also determine the track A—A in FIG. 3 along which the printing block blank 1 is later to be engraved. After this, the CAD system 34 computes the pattern information or data files shown in FIG. 5, the number of data files match the number of regions which are to be removed.

As already stated, this can be done using only a single or a plurality of successively used laser beams. The pattern information or data files D3 to D5 are then transmitted by the CAD system 34 to the control computer 35, where they are stored in order finally to be fed in the event of machining to the machine control system. The latter ensures the rotation of the printing block blank 1 about its central axis, the corresponding displacement of the carriage 23 in order to guide the laser beam 28 along the predetermined track on the surface of the printing block blank 1, and the switching of the laser beam 28 on and off in line with the data files D3 to D5 using the modulator 30 which here is constructed as an acousto-optical modulator.

Figure 7:
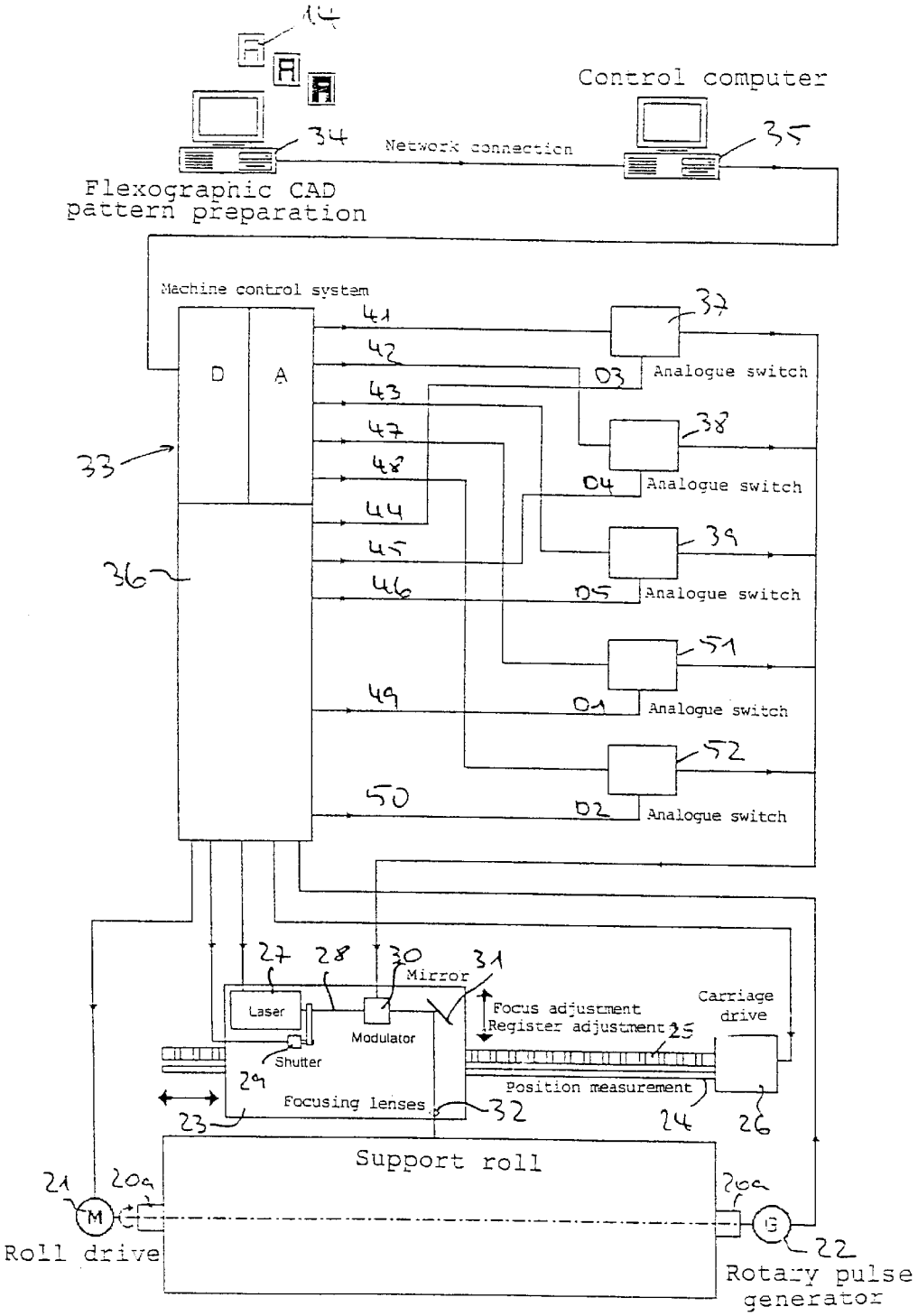
FIG. 7 illustrates a more detailed structure of the device shown in FIG. 6.

The internal structure of the machine control system is presented in more detail in FIG. 7. Elements equivalent to those in FIG. 6 are given the same reference numbers and are not described again.

The machine control system 33 contains a central control unit 36 together with a plurality of analogue switches, in this case five analogue switches 37, 38 and 39 and also 51 and 52. On the output side each of the analogue switches 37 to 39 is connected to the control input of the modulator 30. In contrast, on the input side each analogue switch 37 to 39 and 51, 52 receives a different control voltage via the leads 41, 42 and 43 and 47, 48 respectively from the central control unit 36. Thus, depending on start-up of one of the analogue switches 37 to 39 and 51, 52 a control voltage of different magnitude arrives at the modulator 30 so that in line with the selection of one of the analogue switches 37 to 39 and 51, 52 the intensity or power of the laser beam 28 can be controlled by the modulator 30. The selection or actuation of each of the analogue switches 37 to 39 and 51, 52 ensues via control leads 44, 45 and 46 and 49, 50 through which the central control unit 36 sends in each case one of the data files D3, D4 and D5 and D1, D2 to one of the analogue switches 37, 38 and 39 and 51, 52.

In what follows it may be assumed that the pattern shown in FIG. 4 is to be engraved along a perimeter line of the printing block blank 1, using in fact only the single laser 27. In this case, for example, four revolutions of the printing block blank 1 are necessary or four passes over the track. In the first pass of the track the surface region over section A in FIG. 4 is to be engraved using relatively low radiation intensity. For this purpose the data file D3 arrives at the control input of the analogue switch 37 which then in keeping with the data file D3 connects a relatively low voltage and transmits this switched low voltage to the control input of the modulator 30. On the next pass of the track the data file D4 arrives at the control input of the analogue switch 38 which now, for example, for the erosion of the region B in FIG. 4 switches a higher voltage in agreement with the data file D4 and transmits this higher voltage to the control input of the modulator 30 50 that now the laser beam 28 reaches the surface of the printing block blank 1 with higher intensity. The third pass of the track control ensues through the use of the data file D5 at the control input of the third analogue switch 39 which can likewise actuate a higher voltage for controlling the modulator. In the fourth pass of the track the data file D1 finally arrives at the analogue switch 51 50 that the latter switches the laser radiation from which the voltage reaching the modulator is that which the analogue switch 51 receives via the lead 47. If a different voltage is to be switched the data file D2 may be used which now switches the analogue switch 52 in order to remove the regions 14*a* at a different intensity or radiation power.

The above-mentioned operation may be repeated for a next parallel track, etc. The above system can of course be provided in multiples in order to shorten the engraving time. In each pass of the track the carriage 23 is then stationary. Engraving along helical paths is also possible, with the further possibility of working in interlace mode in order to avoid block boundaries.

Figure 8:
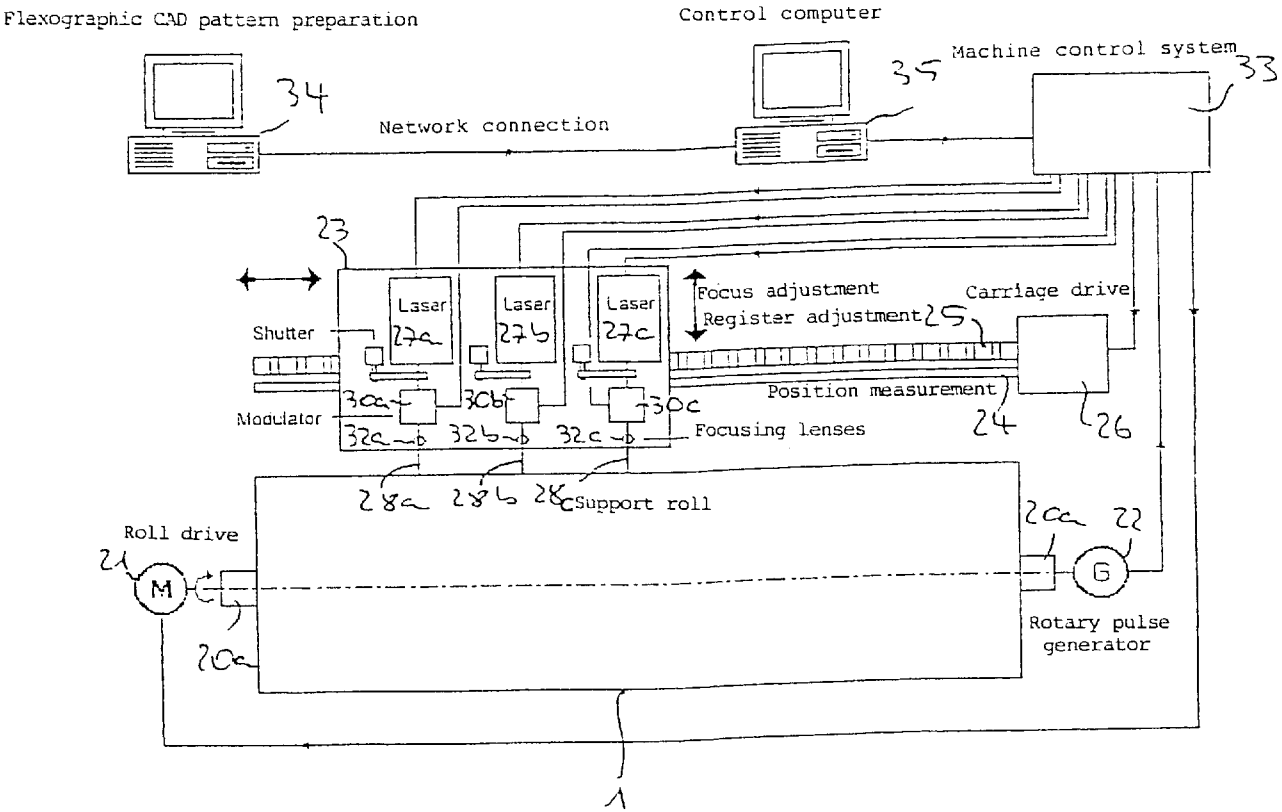
FIG. 8 illustrates a device according to a second embodiment of the invention for producing a printing block.

FIG. 8 shows a second embodiment of a laser machining system according to the invention. Elements equivalent to those in FIGS. 6 and 7 are once more provided with the same reference numbers and are not described again.

As a departure from the embodiment exemplified in FIGS. 6 and 7, the carriage 23 here has three lasers 27*a* to 27*c* located alongside one another. Assigned to each of these lasers is a dedicated shutter, a dedicated modulator and a dedicated lens system. Assigned to each of the modulators 30*a* to 30*c*, which again are constructed as acousto-optical modulators, is one dedicated analogue switch in the machine control system 33, such as the analogue switches 37 to 39 in FIG. 7. They are likewise supplied with the same or different input voltages so that they can provide focused laser radiation of differing power.

When on turning the cylindrical printing block blank 1 about its longitudinal axis and the carriage 23 is simultaneously displaced from right to left in FIG. 8, the focused laser beams 28*a* to 28*c* run on threaded linear tracks over the surface of the printing block blank 1. In doing so, the focused laser beam 28*a* precedes and first of all engraves the surface regions corresponding to the regions A in FIG. 4. Next, the focused laser beam 28*b* runs along the same linear threaded track and in doing so engraves regions corresponding to the regions B in FIG. 4. After that the same track is traversed by the focused laser beam 28*c* in order to engrave the regions along the track corresponding to the regions C in FIG. 4. In this case also the power of the focused laser beams can be controlled to match the exemplified embodiment shown in FIG. 7 by applying, for instance, voltages of different magnitude to the control input of the acousto-optical modulators and actuating them in line with the corresponding data files. Here also block operation would be possible in which only cylindrical tracks are scanned.

Figure 9:
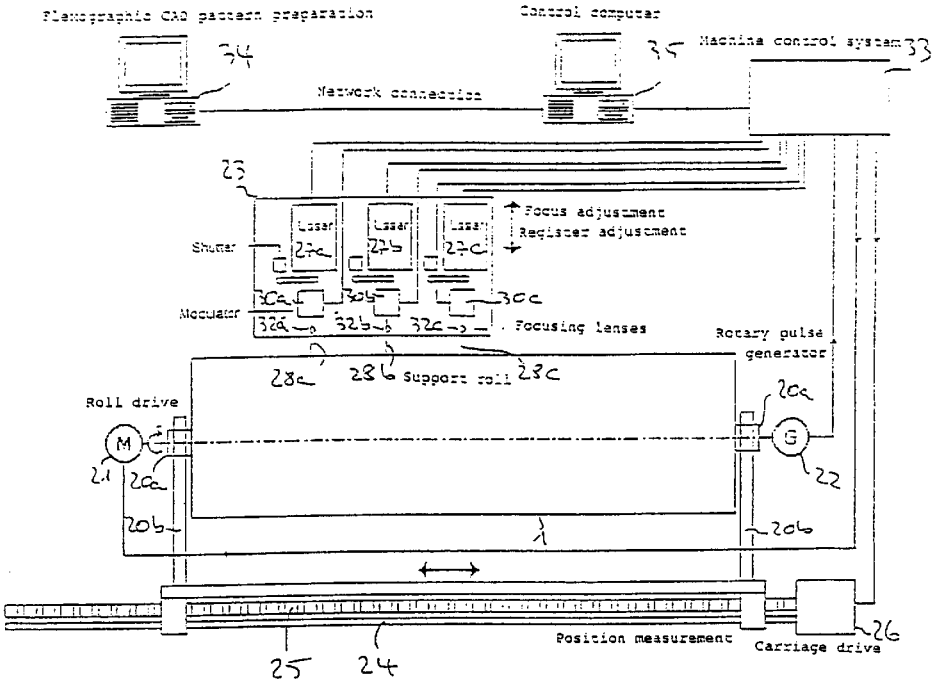
FIG. 9 illustrates a device according to a third embodiment of the invention for producing a printing block.

A third exemplified embodiment of the device according to the invention is illustrated in FIG. 9. Once again, identical elements to those in FIGS. 6 to 8 are provided with the same reference numbers and are not described again. Here, in contrast with the embodiment exemplified in FIG. 8, the carriage 23 is arranged in a fixed position, that is it is no longer displaceable in the longitudinal direction of the cylindrically shaped printing block blank. On the contrary, the printing block blank 1 is now mounted displaceably in the longitudinal direction of the cylinder for which purpose it is now arranged on the guides 24 and is driven, for example, with the aid of the screw spindle 25 which itself is turned by the rotary drive 26 in one or other direction. This arrangement is advantageous when very many lasers are used for the simultaneous machining of the printing block blank 1 since in this case this large number of lasers cannot then be transported with sufficient stability and lack of vibration on a mobile carriage.

Figure 10:
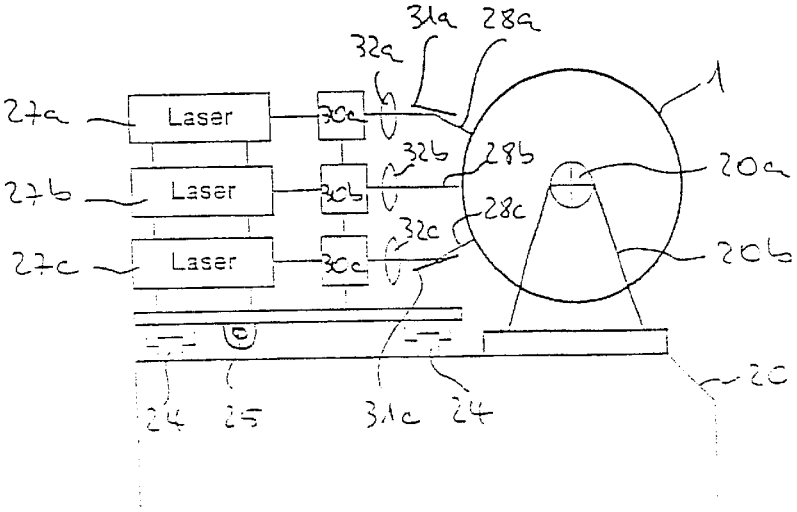
FIG. 10 illustrates a device according to a fourth embodiment of the invention for producing a printing block.

A fourth exemplified embodiment of the system according to the invention is shown in FIG. 10. In this case three focused laser beams 28*a*, 28*b*, 28*c* come simultaneously onto a track running in the circumferential direction of the cylindrical printing block blank 1. In doing so the three focused laser beams 28*a* to 28*c* are offset relative to one another in this circumferential direction. They are generated with the aid of three lasers 27*a*, 27*b* and 27*c* which are arranged, by way of example, on top of one another on the carriage 23 and can be actuated or modulated by three acousto-optical modulators 30*a* to 30*c*. Focusing ensues by means of three lenses 32*a* to 32*c*, deflecting mirrors 31*a* and 31*c* being provided for the uppermost and lowermost beam. Here too, the three laser beams could be controlled by means of the acousto-optical modulators 30*a* to 30*c* in accordance with the scheme shown in FIG. 5 if, for example, the modulator 30*a* were also connected to the analogue switches 51, 52.

Figure 11:
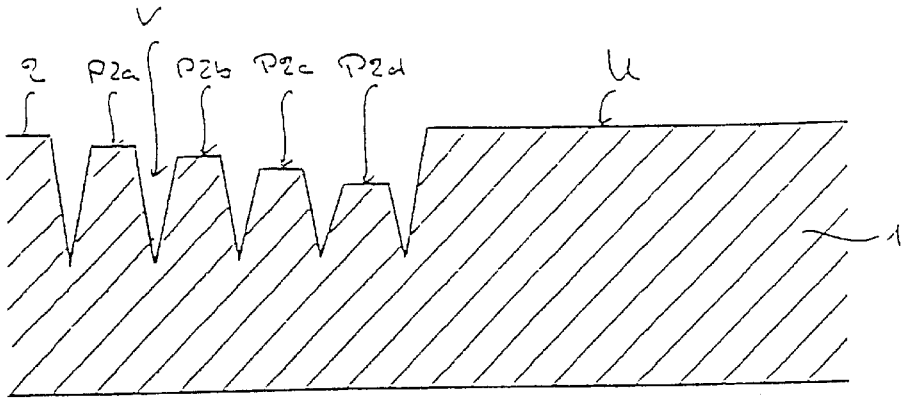
FIG. 11 is a cross-sectional view through a flexographic printing block produced in accordance with the invention.
Figure 12:
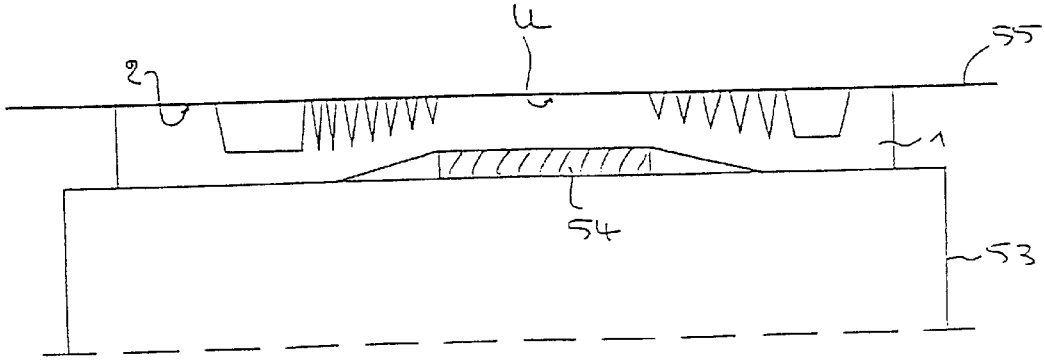
FIG. 12 illustrates the flexographic printing block shown in FIG. 11 during the printing process.

FIG. 11 shows a cross section through a flexographic printing block which has a relatively large full print area U which is surrounded by a dot raster which is blocked by a plurality of small mountain-like structures having plateaus P2*a*, P2*b*, P2*c* and P2*d* which are divided from one another by recesses V. The full print area U is located in the surface 2 of the printing block blank 1, while the plateaus P2*a*, P2*b*, P2*c* and P2*d* are located below the surface 2 these being all the deeper the closer they are to the full print area U.

If the printing block shown in FIG. 11 is placed for purposes of printing onto the surface of a roller 53 and an underlay 54 (add-on) is arranged between the full print area U and the roller 53 the printing block is relatively highly compressed in the region of the full print area U when the latter is pressed against a print surface 55. The underlay 54 is restricted to the region of the full print area U, the print contact force against the print surface 55 being chosen so that the surface 2 of the printing block lying outside the full print area U is straight when it comes into contact with the print area 55 and is virtually not pressed or only slightly pressed. As a result of the presence of the underlay 54 then naturally the lower-lying plateaus P2*a*, P2*b*, P2*c* and P2*d* are also raised in the pressing operation but with the latter plateaus, e.g. P2*d*, being raised more than the former plateaus, e.g. P2*a*. All of the plateaus move so far upwards until they are again flush with the surface 2 and are practically not in pressing contact with the print area 55. This is the case only for the full print area U. Strong contact pressure between the print area 55 and the plateaus P2*a*, P2*b*, P2*c* and P2*d* is thus avoided By this means, better print quality is ensured. Furthermore, print quality is improved in that printing material (ink: paste, etc) can deposit better on the level plateaus P2*a*–P2*d*.

The invention being thus described, it will be obvious that the same may be varied in many ways. Such variations are not to be regarded as a departure from the spirit and scope for the invention, and all such modifications as would be obvious to one skilled in the art are intended to be included within the scope of the following claims.

What is claimed is:

1. A method for producing a printing block in which a relief is introduced into a surface of a printing block blank comprising the steps of:

removing material of the printing block blank in regions along tracks by radiation; and forming recesses, between which plateaus result, wherein the surface of the printing block blank located between the recesses also is removed by radiation to obtain lower-lying plateaus.

2. The method according to claim 1, wherein in order to set the depth of the lower-lying plateaus, the surface of the printing block blank located between the recesses is removed by radiation, correspondingly adjusted in its intensity or power.

3. The method according to claim 1, wherein in order to set the depth of the lower-lying plateaus, the surface of the printing block blank located between the recesses is removed by multiple exposure to radiation.

4. The method according to claim 3, wherein the exposure to radiation ensues with one beam, which is guided repeatedly along one track.

5. The method according to claim 3, wherein the exposure to radiation ensues with multiple beams, which are guided along the same track.

6. The method according to claim 5, wherein the multiple beams are arranged alongside one another in a direction which runs transverse to a longitudinal direction of the track.

7. The method according to claim 5, wherein the multiple beams are arranged alongside one another in a direction which runs in a longitudinal direction of the track.

8. The method according to claim 3, wherein the beams are moved relative to the printing block blank.

9. The method according to claim 3, wherein the printing block blank is moved relative to the beams which are fixed in a position.

10. The method according to claim 1, wherein the depth of the lower-lying plateaus is set differently as a function of its position in the relief.

11. The method according to claim 10, wherein the depth of the lower-lying plateaus increases in the direction towards a full surface located in the surface of the printing block blank.

12. The method according to claim 1, wherein the recesses are formed by repeatedly exposing the surface of the blank to radiation.

13. The method according to claim 1, wherein the exposure of the printing block blank to radiation is effected using laser radiation.

14. The method according to claim 1, wherein the printing block blank includes a polymer material which is irradiated with the radiation.

15. The method according to claim 14, wherein the printing block blank is substantially plate-shaped and composed of the polymer material, and wherein the printing block blank is laid on the surface of a rotatably mountable cylinder.

16. The method according to claim 14, wherein the printing block blank is formed by pulling or applying the polymer material onto the surface of a rotatably mountable cylinder.

17. The method according to claim 1, wherein the exposure to radiation of the printing block blank along one of the tracks ensues as a function of data files.

18. The method according to claim 1, wherein the exposure to radiation of the printing block blank along one of the tracks ensues as a function of data files, each of which is assigned to one of relief regions of a recess to be removed to enable removal at different depths.

19. The method according to claim 18, wherein the respective data files are used to modulate the beams.

20. The method according to claim 19, wherein assigned to the respective data files are different control voltages in each case for modulating the beams.

21. A device for producing a printing block comprising:

a mount for holding a printing block blank;

an optical device for exposing radiation on a surface of the printing block blank along a track, said optical device including at least one beam to remove regions of the printing block blank to form recesses; and a control device which uses a data file containing beam-on and beam-off control commands which control changes in the intensity of the at least one beam on its path along the track, wherein the control device is constructed in such a way that it provides at least one data file containing beam-on and beam-off commands to remove by radiation the surface of the printing block blank located between the recesses to obtain lower-lying plateaus.

22. The device according to claim 21, wherein the optical device is constructed in such a way that it emits at least one beam, and wherein the control device is constructed in such a way that in each case one beam passes through one and the same track several times and with every pass of the track, a new data file can be read out.

23. The device according to claim 21, wherein the optical device is constructed in such a way that it emits a plurality of beams which are each controllable by one separate data file.

24. The device according to claim 23, wherein the beams are arranged alongside one another in a direction running transverse to a longitudinal direction of the track.

25. The device according to claim 23, wherein the beams are arranged alongside one another in a direction running in a longitudinal direction of the track.

26. The device according to claim 23, wherein the beams are laser beams.

27. The device according to claim 23, wherein modulators are provided which control an intensity of the beams and which are actuable, at least indirectly, via the data files.

28. The device according to claim 27, wherein each modulator is connected to at least one analogue switch through which a control voltage is suppliable to the modulator and wherein the analogue switch is switchable by the data file.

29. The device according to claims 28, wherein an analogue switch is assigned to each modulator, and wherein each analogue switch is switchable by one of the plurality of data files needed for engraving along a track, and wherein the analogue switches each switch different control voltages.

30. The device according to claim 27, wherein the modulators are acousto-optical modulators.

31. The device according to claim 27, wherein the modulators are deflectors or beam deflectors.

32. The device according to claim 23, wherein a modulator is connected to the outputs of a plurality of analogue switches, and wherein each analogue switch is switchable by one of the plurality of data files needed for engraving along a track, and wherein the analogue switches each switch different control voltages.

33. The device according to claim 21, further comprising a printing block blank constructed as a cylinder mounted rotatably about its longitudinal axis which carries on its surface an elastic material.

34. The device according to claim 33, wherein a carriage is arranged displaceably in the direction of the longitudinal axis of the cylinder and carries at least parts of the optical device.

35. The device according to claim 33, further comprising a cylinder displaceable in direction of its longitudinal axis and the optical device is in a fixed position.

36. The device according to claim 21, wherein the beams are focused beams.

* * * * *